US005156104A

United States Patent [19]

Wada

[11] Patent Number: 5,156,104

[45] Date of Patent: Oct. 20, 1992

[54] LOADING APPARATUS WITH SHIRRING UNIT

[75] Inventor: Minoru Wada, Chofu, Japan

[73] Assignee: Juki Corporation, Tokyo, Japan

[21] Appl. No.: 720,933

[22] Filed: Jun. 25, 1991

[30] Foreign Application Priority Data

Jun. 25, 1990 [JP] Japan ..... 2-66959

[51] Int. Cl.[5] ..... D05B 35/08; D05B 21/00

[52] U.S. Cl. ..... 112/121.12; 112/135; 223/32

[58] Field of Search ..... 112/121.12, 121.15, 112/104, 113, 2, 132, 135, 144; 223/28, 30, 31, 32

[56] References Cited

U.S. PATENT DOCUMENTS

| | | | |
|---|---|---|---|
| 3,034,458 | 5/1962 | Bennison | 112/121.12 |
| 3,315,625 | 4/1967 | Bennison | 112/121.12 X |
| 4,079,682 | 3/1978 | Nishiwaki | 223/30 X |
| 4,527,492 | 7/1985 | Gill | 112/121.12 |

*Primary Examiner*—Peter Nerbun

*Attorney, Agent, or Firm*—Morgan & Finnegan

[57] ABSTRACT

A loading apparatus for an automatic sewing machine which includes a setting device for setting thereon a lower workpiece, a shirring plate hinge to the setting device, and a work holder having an upper blade and a lower blade for holding the workpiece therebetween during the sewing operation. The shirring plate has forks for mounting thereon an upper workpiece. The upper blade has corresponding forks for engaging in the forks of the shirring plate. The setting device is movable relative to the work holder to transfer the workpiece to the work holder.

2 Claims, 6 Drawing Sheets

LOADING APPARATUS WITH SHIRRING UNIT

FIELD OF THE INVENTION

The present invention relates to a loading apparatus for an automatic sewing machine with a shirring unit for shirring a workpiece when moved from a setting device to a work holder.

BACKGROUND OF THE INVENTION

A conventional shirring operation is shown in FIGS. 6(*a–c*) where a collar 5 is formed, as shown in FIG. 6(*c*), by placing a lining workpiece 3 over a top workpiece 2 and a back workpiece 1. These workpieces are then stitched along the margins, as shown in FIG. 6(*b*), forming a seam 4 on three sides. The lining workpiece 3 extends along the remaining side. The three workpieces are then turned over and up. The bent collar 5 when properly sewn has a good curved appearance if the top workpiece 2 of the collar 5 is suitably slackened.

For maintaining the good curved shape desired in the collar 5, a conventional shirring unit has heretofore been proposed, as shown in FIG. 7, which provides a shirring plate 8 that includes a stitch opening 7 in a bottom 6 of a cassette which follows the contour of the collar. Shirring plate 8 has hinges 9*a* and 9*b* on the bottom 9. Shirring plate 8 also has projections 8*a* and 8*b* at one end located inward of the first stitch opening 7. A cover 10 of the cassette is coupled by the FIGS. 9*a* and 9*b* to the bottom 6. Cover 10 is formed with a second stitch opening 11 corresponding to the first stitch opening 7, and having recesses 12*a* and 12*b* which fit over the projections 8*a* and 8*b* of the cassette bottom 6.

The conventional shirring unit as shown in FIGS. 7 and 8 is arranged so that a back or lower workpiece 1 is laid on a bottom 6 of the cassette, and then covered with the shirring plate 8. The top and lining workpieces 2 and 3 are then placed atop the shirring plate 8. The collar 5 which is composed of the top, back, and lining workpieces 2, 1, and 3, is clamped by the cassette cover 10. The cassette is then mounted on a profile stitcher to sew the collar along its margins with a needle 13, thereby obtaining the shirred collar.

The aforementioned cassette requires not only clamping the collar 5, which is composed of the back, top, and lining workpieces 1, 2, and 3, between the cassette bottom 6 and cover 10, but also requires setting the collar 5 to the profile stitcher. Further, the profile stitcher is required to remove the cassette therefrom after the collar 5 has been sewn and then takes out the collar 5 from between the cassette bottom 6 and cover 10. The action involves not only increased labor, but also involves many complex operations.

It is, therefore, an object of the present invention to provide a loading apparatus with a shirring unit which is fabricated to shirr the collar when it is conveyed to the work holder by simply laying the collar on the setting device, thereby decreasing the manual effort of mounting the collar and thus increasing operation efficiency.

SUMMARY OF THE INVENTION

To accomplish these and other objects, an automatic sewing machine is provided wherein workpieces as set in a setting device are conveyed to a work holder, and the workpieces on the work holder are then sewn by moving the sewing machine relative to the workpieces. A shirring plate is disposed on the back workpiece placed in the setting device. The work holder is provided with forks which correspond to the forks of the shirring plate, whereby the workpieces are shirred when they are conveyed from the setting device to the work holder.

BRIEF DESCRIPTION OF THE DRAWINGS

The invention will be described in greater detail below with reference to the attached drawings, in which:

FIG. 6(*b*) is a perspective view of the collar after stitching;

FIG. 6(*c*) is a perspective view of a finished collar, which is obtained by turning over the collar as stitched;

DETAILED DESCRIPTION OF THE INVENTION

Figure 1:
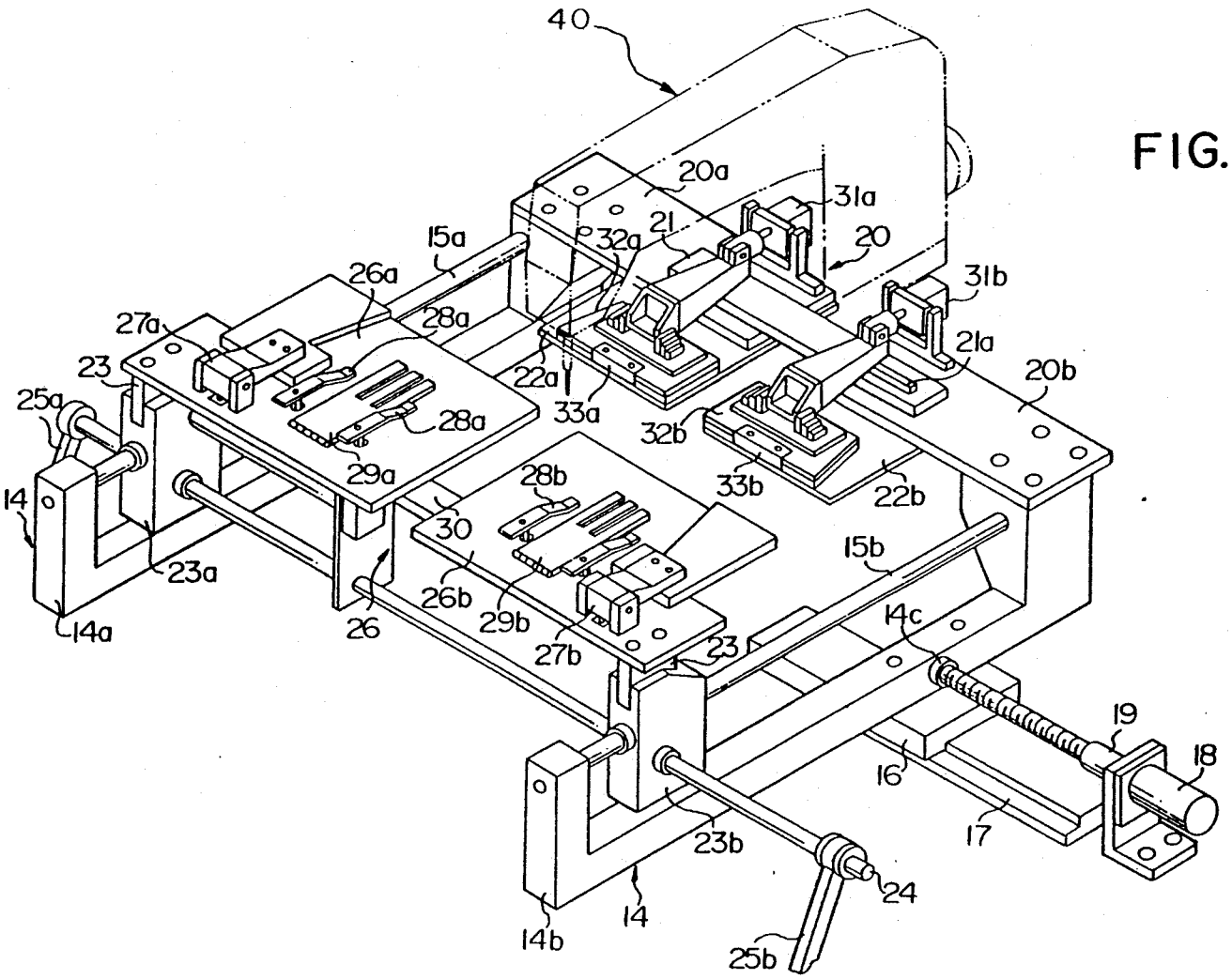
FIG. 1 is a perspective view of an automatic sewing machine according to the present invention.
Figure 2:
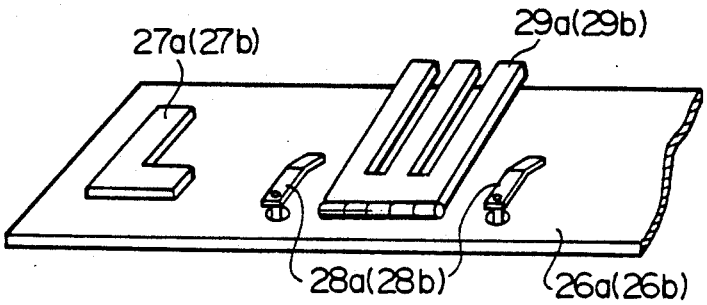
FIG. 2 is a detailed view of a setting device as shown in FIG. 1.
Figure 3:
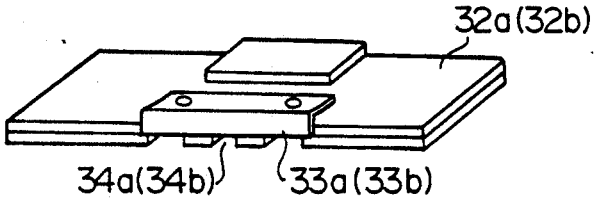
FIGS. 3 and 4 are also detailed views of a work holder as shown in FIG. 1.
Figure 4:
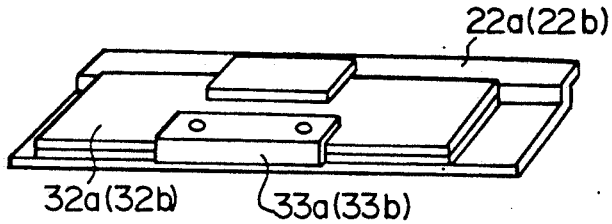
Figure 5A:
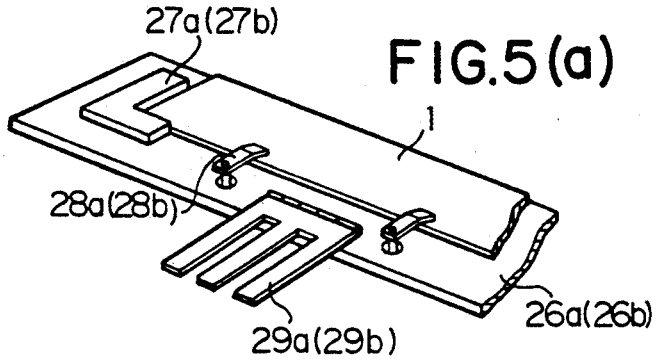
FIGS 5(*a*) through 5(*e*) are sequential representations demonstrating the manner of operation of the instant apparatus shown in FIG. 1.
Figure 5B:
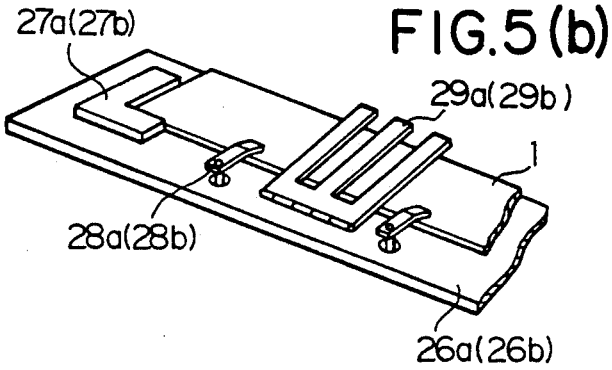
Figure 5C:
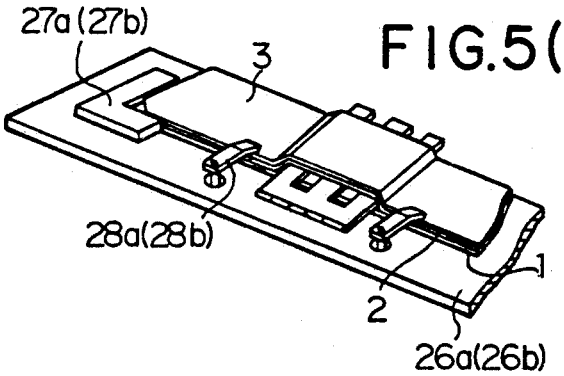
Figure 5D:
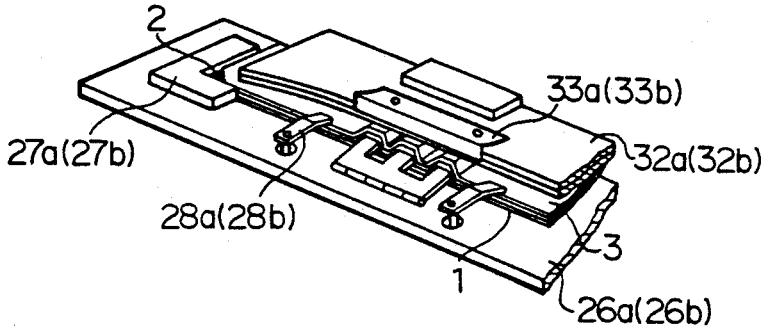
Figure 5E:
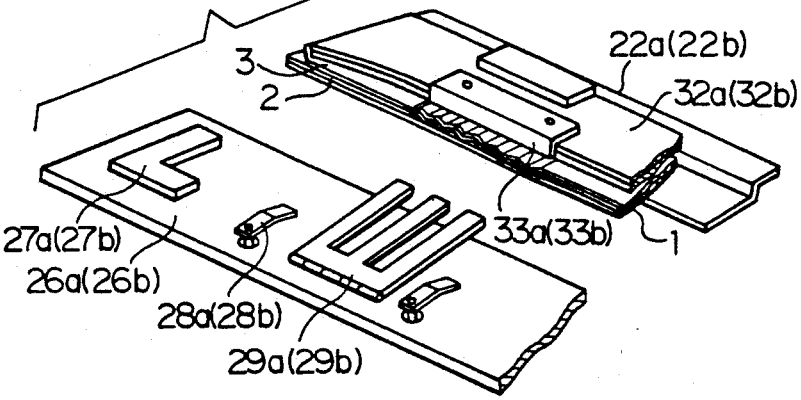
Figure 6A:
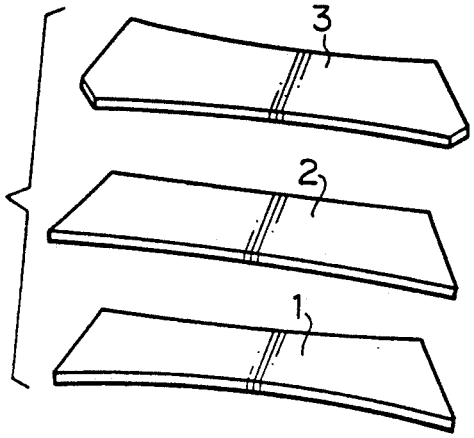
(PRIOR ART) FIG.6(a)
FIG. 6(*a*) is a perspective view of workpieces before stitching a collar.
Figure 6B:
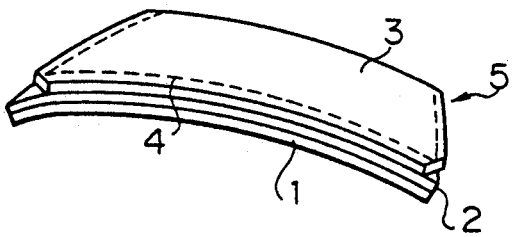
Figure 6C:
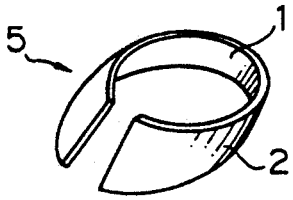
Figure 7:
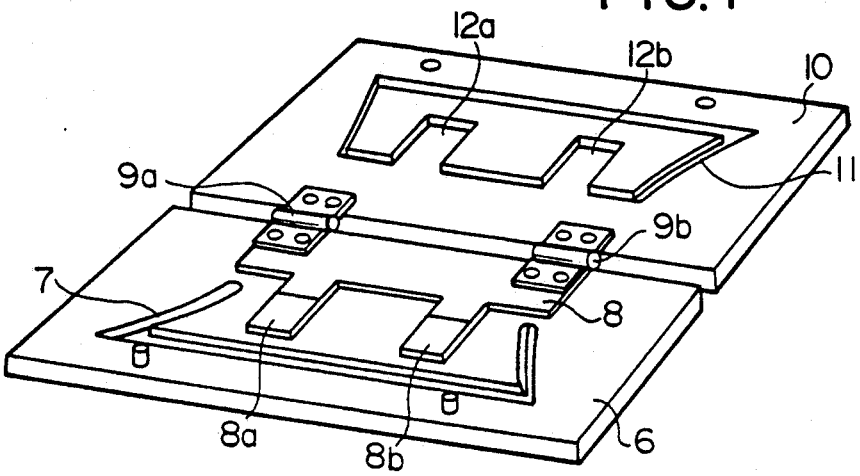
(PRIOR ART) FIG. 7
FIG. 7 is a perspective view of a conventional cassette for shirring the collar workpieces.
Figure 8:
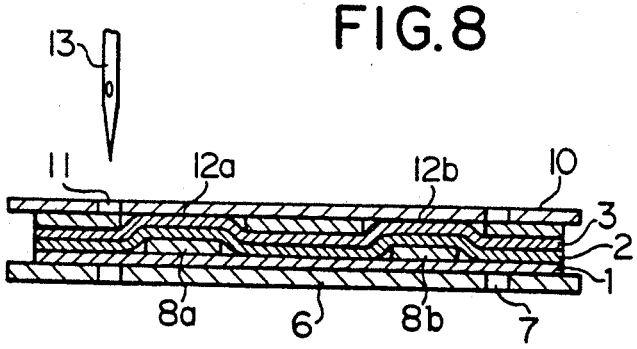
(PRIOR ART) FIG. 8
FIG. 8 is a sectional view showing the manner in which the collar workpieces are sewn by a conventional cassette.

A loading apparatus with a shirring unit according to the present invention is shown in FIG. 1. One embodiment of the present invention includes a support block 14 having supports 14*a* and 14*b*, which are disposed in a parallel with each other, with one support 14*a* fastened and a second 14*b* having a shift base 16, and loader spindles 15*a* and 15*b* arranged on the supports 14*a* and 14*b*. The shift base 16 is formed with a rail 17 which is disposed at a right angle to the second support 14*b*, thereby allowing the shift base 16 to move thereon. The second support 14*b* of the support block 14 has a tapped hole 14*c* in which to receive therein a ball screw 19 which is coupled to a rotary shaft of a pulse motor 18.

A work holder 20 is divided into two segments to form mount elements 20*a* and 20*b* which are secured to the supports 14*a* and 14*b*, respectively. A spacer 21 is fixed at the mount element 20*a* end and extends to the mount element 20*b* end. A slot 21*a* is formed at the mount element 20*b* end of the spacer 21, said slot 21*a* to receive a screw (not shown) attached to the mount element 20*b*. A lock lever (not shown) is engaged with the screw. With this arrangement, the lock lever is loosened to adjust the distance between the mount elements 20*a* and 20*b*. The mount elements 20*a* and 20*b* carry thereon lower blades 22*a* and 22*b* mounted thereto. A pair of shift brackets 23 includes braces 23*a* and 23*b* which are slidably fitted over the loader spindles 15*a* and 15*b* respectively. A loader drive shaft 24 is disposed to pass through the braces 23*a* and 23*b* to slidably move the latter. A pair of levers 25*a* and 25*b* are coupled to the loader drive shaft 24 at the opposite ends thereof, said levers are adapted to be driven by cylinders (not shown).

Panels 26*a* and 26*b* are firmly mounted atop the braces 23*a* and 23*b*. Atop panels 26*a* and 26*b* are setting devices 27*a* and 27*b* and work clamps 28*a* and 28*b*. Also atop panels 26*a* and 26*b* are shirring plates 29*a* and 29*b* which are pivotally mounted by hinges on the panels 26*a* and 26*b*. A panel carriage 30 is adapted to attach one end to the panel 26*a*, and the other end of carriage 30 is slidably mounted by a panel support (not shown).

Work holders 31*a* and 31*b*, as shown in FIG. 1, are mounted on the mount elements 20*a* and 20*b*. Said work holders 31*a* and 31*b* hold movable elements to which upper blades 32*a* and 32*b* are attached. Shirr keepers are set by screws to the upper blades 32*a* and 32*b*. The upper blades 32*a* and 32*b* are provided on the undersides thereof with forks 34*a* and 34*b* to mesh with or engage in the corresponding forks of the shirring plates 29*a* and 29*b*.

It will be appreciated from FIG. 5(*a*), according to the automatic sewing machine arranged as aforementioned, that the shirring plate 29*a*(29*b*) of the setting device 27 is open to receive the lower workpiece 1 on the panel 26*a*(26*b*). In FIG. 5(*b*), the shirring plates 29*a*(29*b*) are shown swung back to the lower workpiece 1 to fasten the workpiece 1 at the top of the setting devices 27*a*(27*b*). In FIG. 5(*c*), the lining workpiece 3 is shown superimposed upon the upper workpiece 2 which is itself laid on the shirring plate 29*a*(29*b*). The shirring plate 29*a*(29*b*) in turn lies over the lower workpiece 1 to so lower the clamps 28*a*(28*b*) as to press against the lining workpiece 3. When the shift bracket 23, as shown in FIG. 1, moves and overlays the lower blades 22*a*(22*b*), the forks which are formed in the upper blades 32*a*(32*b*) of the work holders 31*a* and 31*b*, mesh with and engage the corresponding forks of the shirring plates 29*a* and 29*b* to urge and form only the upper workpiece into a corrugated form. Under such circumstances, as shown in FIG. 5(*e*), the panels 26*a*(26*b*) are removed to shirr the upper 2 and lining workpieces 3, and then thereby sewing the workpieces with a sewing machine 40. Thus, the collar workpieces are set by the setting device, moved by the work holder, and automatically conveyed to a stacker.

In this manner, the loading apparatus with the shirring unit, as embodied in the present invention, is capable of shirring the collar workpieces by moving the setting device in the direction of the work holder 20, thereby conveying the collar 5 to the work holder 20 upon setting the collar 5 to a setting device 26, thereby eliminating operations such as mounting the collar to the cassette and removing the sewn collar from the cassette as required by the prior art.

The loading apparatus with the shirring unit described above is operated as follows. The shirring plate is coupled by a hinge on the setting device thereto, and is initially left open to set the lower work piece. The shirring plate is then dispose upon the lower workpiece. The upper workpiece is then placed on the shirring plate, and above the upper workpiece is placed the lining workpiece. These workpieces are then pressed with the work holder and the work clamp. The loading apparatus with the shirring unit is then started, and the setting device is moved in the direction of the work holder, thereby lowering the work holder and allowing the forks of the upper blade to mesh with or engage in the corresponding forks of the shirring plate, so that the workpieces are shirred.

Although the invention has been described in detail above by way of reference to the drawings and the preferred embodiment, it should be understood that the invention is not limited to the embodiment described herein, but should be interpreted in accordance with the claim that follows.

I claim:

1. A loading apparatus with a shirring unit in an automatic sewing machine comprising:

a setting device for setting thereon a first workpiece;

a shirring plate hinged to said setting device, said shirring plate having forks for mounting thereon a second workpiece;

a work holder having an upper blade and a lower blade for holding the workpiece therebetween during a sewing operation said upper blade having means for engaging said forks of said shirring plate; and means for moving said setting device with the workpiece relative to said work holder to transfer the workpiece to said work holder.

2. A workpiece loading apparatus for an automatic sewing machine, wherein said sewing machine stitches along a predetermined contour of a plurality of stacked workpieces, said apparatus comprising:

a work holder having an upper blade and a lower blade, wherein said upper and lower blades form an adjustable opening for holding a portion of said workpieces, and wherein said work holder is movable relative to said sewing machine;

a setting member having a shirring plate, wherein said shirring plate has a plurality of forks, wherein said forks' are interposed between said workpieces, wherein said setting member is movable, wherein said forks of said shirring plate are oriented in the direction of movement of said setting member; and meshing means provided on a surface of said upper blade of said work holder for meshing with said forks of said setting member;

wherein said movable setting member moves toward and meshes with said work holder having an opening between said upper and lower blades, wherein after meshing said movable setting member moves away from said work holder leaving said stacked workpieces held by said work holder, and wherein said sewing machine stitches along said predetermined contour of said plurality of stacked workpieces.

* * * * *